US008371319B2

(12) United States Patent
Meibos et al.

(10) Patent No.: US 8,371,319 B2
(45) Date of Patent: Feb. 12, 2013

(54) UMBRELLA ANCHORAGE AND ACCESSORIES

(75) Inventors: Melissa Jane Meibos, North Logan, UT (US); David W. Meibos, North Logan, UT (US)

(73) Assignee: Melissa Jane Meibos, South Jordan, UT (US)

( * ) Notice: Subject to any disclaimer, the term of this patent is extended or adjusted under 35 U.S.C. 154(b) by 408 days.

(21) Appl. No.: 12/640,991

(22) Filed: Dec. 17, 2009

(65) Prior Publication Data

US 2010/0154848 A1 Jun. 24, 2010

Related U.S. Application Data

(60) Provisional application No. 61/140,533, filed on Dec. 23, 2008.

(51) Int. Cl.
*A45B 3/00* (2006.01)

(52) U.S. Cl. ..... 135/16; 135/118; 135/905; 135/98; 248/532; 248/156; 108/50.12

(58) Field of Classification Search ..... 135/16, 135/98, 118, 902, 905; 108/50.11–50.13; 248/156, 530, 532, 545, 218.4; 116/173; 52/156, 165, 293.3
See application file for complete search history.

(56) References Cited

U.S. PATENT DOCUMENTS

| | | | | | |
|---|---|---|---|---|---|
| 1,736,177 | A * | 11/1929 | Snook | 52/157 |
| 2,799,543 | A * | 7/1957 | Tomaselli | 108/50.12 |
| 4,753,411 | A * | 6/1988 | Lechner et al. | 248/533 |
| 4,953,819 | A * | 9/1990 | Davis | 248/227.3 |
| 5,161,561 | A * | 11/1992 | Jamieson | 135/16 |
| 5,273,062 | A * | 12/1993 | Mozdzanowski | 135/16 |
| 6,272,798 | B1 * | 8/2001 | Cockman | 52/155 |
| 7,155,860 | B1 * | 1/2007 | Ferguson, III | 47/66.6 |
| 7,520,485 | B1 * | 4/2009 | Giannetto | 248/530 |
| 7,549,430 | B1 * | 6/2009 | Gravlee | 135/16 |
| 2004/0129184 | A1 * | 7/2004 | Kraker | 108/50.12 |
| 2010/0163086 | A1 * | 7/2010 | Chavez et al. | 135/16 |

* cited by examiner

*Primary Examiner* — Winnie Yip
(74) *Attorney, Agent, or Firm* — David W. Meibos

(57) ABSTRACT

The present invention provides umbrella anchors and accessories that facilitate the use of umbrellas over a wide variety of ground surfaces. An anchor may have a generally tubular shape with a bore that receives the bottom end of a pole of an umbrella. The anchor may have a tip that penetrates the ground in response to application of linear force, and a flange that limits the depth of penetration of the anchor into the ground and adds stability. Alternatively, an anchor may have a flange positioned distally to lie underneath a deck or other man-made surface. An anchor may have a flange that is angled relative to the remainder of the anchor to facilitate placement of the umbrella at a angle relative to ground level. A cover may prevent entry of debris into the anchor bore. Modular tables or accessory trays may be attached around the pole of the umbrella.

17 Claims, 9 Drawing Sheets

UMBRELLA ANCHORAGE AND ACCESSORIES

RELATED APPLICATIONS

This application claims the benefit of U.S. Provisional Application Ser. No. 61/140,533, filed Dec. 23, 2008 and entitled UMBRELLA ANCHORAGE AND ACCESSORIES, the disclosure of which is incorporated herein by reference.

BACKGROUND OF THE INVENTION

1. The Field of the Invention

The present invention relates to anchors, tables, implement holders, and other accessories for large umbrellas.

2. The Relevant Technology

Many people use large market-style, patio-style, or beach-style umbrellas (collectively, "group umbrellas") to provide shelter from sun, rain, or wind, and define an intimate space for gatherings. Unfortunately, known group umbrellas have a number of problems.

One persistent problem is the difficulty of keeping the umbrella in place. Umbrella bases are commonly secured to the bottom of umbrella pole to keep umbrellas in place. Such bases may be filled with water or formed of heavy materials, and may have wide footprints to help them resist tipping over. However, gusty weather conditions can easily topple umbrellas secured by even heavy, broad bases. Furthermore, larger, heavier bases are very difficult to transport.

Another problem is the difficulty of supporting food or accessories for gatherings. Tables can clearly be used for this purpose, but such tables often interfere with the positioning of the umbrellas that go with them. Additionally, the legs a table can severely constrict the leg space of people attempting to sit under the umbrella. Further, such arrangements typically lack storage and organization for smaller items such as drinks and silverware, which can easily blow away or tip over under windy conditions. Further, existing tables are often difficult to move; thus, most people taking an umbrella on a trip (for example, to the beach) will simply settle for putting their food and other accoutrements on the ground.

Hence, it would be a clear advancement in the art to provide umbrella anchors that would be easy to use, and would more effectively resist tipping. It would also be an advancement in the art to provide portable tables and other accessories able to support food and other items while providing a comfortable and convenient space for group umbrella users.

BRIEF DESCRIPTION OF THE DRAWINGS

Various embodiments of the present invention will be described in connection with FIGS. 1-7, as follows. These drawings are to be construed as non-limiting examples of the present invention; those of skill in the art will appreciate that a wide variety of modifications are possible within the scope and spirit of the invention.

DETAILED DESCRIPTION

Figure 1:
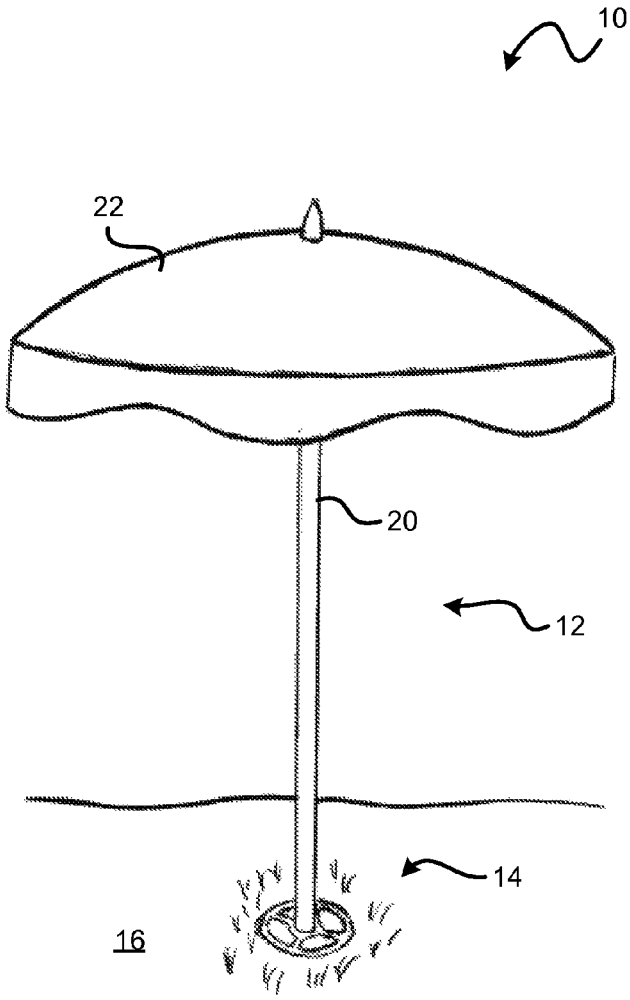
FIG. 1 is a perspective view of an umbrella anchored to the ground through the use of an anchor according to one embodiment of the present invention.

Referring to FIG. 1, a perspective view illustrates a system according to one embodiment of the invention. The system 10 may include a group umbrella 12, or umbrella 12, and an umbrella anchor 14, or anchor 14. The group umbrella 12 may any of a variety of known types, such as market umbrellas, beach umbrellas, and patio umbrellas. The anchor 14 is embedded in the ground 16 to keep the umbrella 12 anchored to the ground 16. The ground 16 is illustrated as soil with grass, but may alternatively be a concrete patio, wood or synthetic deck, or a variety of other surfaces. The umbrella has a pole 20 that supports a canopy 22. A deployment mechanism (not shown) may be used to facilitate and control opening and closing of the canopy 22.

Figure 2:
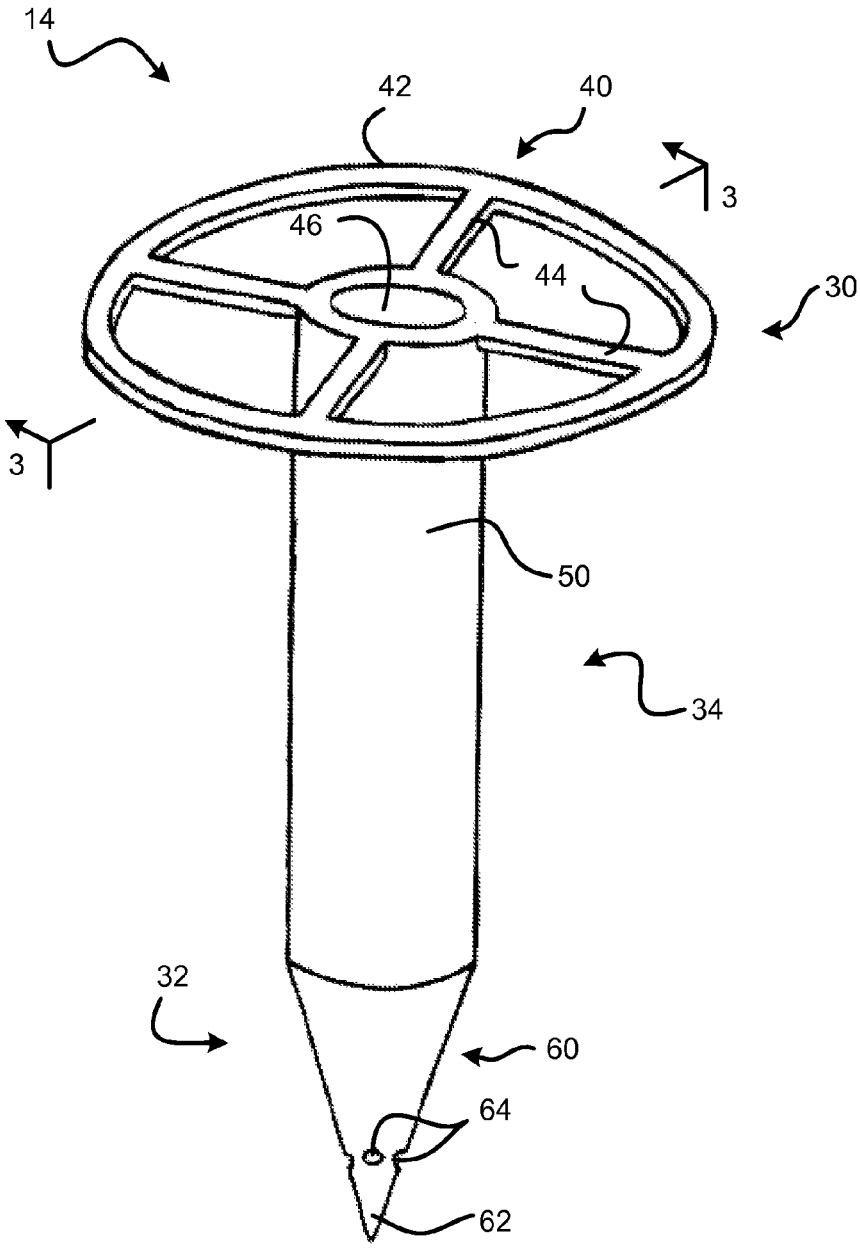
FIG. 2 is perspective view of the anchor of FIG. 1.

Referring to FIG. 2, the anchor 14 of FIG. 1 is shown in greater detail. More specifically, the anchor 14 may have a proximal portion 30, a distal portion 32, and an intermediate portion 34. The proximal portion 30 includes a stabilization feature in the form of a flange 40 that rests against the ground 16 (not shown in FIG. 2) to prevent driving of the anchor 14 too far into the ground 16, and to add stability to keep the anchor 14 from tipping. The flange 40 may include a ring 42 and a plurality of spokes 44 that extend radially from the center of the proximal portion 30 to the ring 42. Advantageously, this geometry maintains a low profile to permit the anchor 14 to remain in place in the ground 16 without impeding other uses of the space, and without unduly restricting the growth of grass or other plant life through the flange 40.

The proximal portion 30 also has an aperture 46 leading to a bore that extends into the intermediate portion 34, and subsequently, to the distal portion 32 of the anchor 14. The aperture 46 may receive the pole with some clearance to facilitate insertion of the pole 20 into the aperture 46 and enable use of the anchor 14 with umbrellas having a wide variety of pole thicknesses. Alternatively, the aperture 46 may receive the pole 20 with minimal clearance, no clearance, or even a slight interference fit to strengthen retention of the pole 20 within the anchor 14, thereby reducing the probability that the umbrella 12 will be pulled from the anchor 14 by wind or other forces.

As shown, the intermediate portion 34 has a cylindrical outer surface 50 that resides within the ground 16 when the anchor 14 is embedded therein. The distal portion 32 has a conical end 60 with a tip 62 and a plurality of weep holes 64 encircling the portion of the conical end 60 adjacent to the tip 62. The tip 62 may be sharp, as shown, to facilitate driving into the ground 16. In the alternative, the tip 62 may be blunted for safety reasons. The weep holes 64 permit water to exit the bore of the anchor 14 into the ground 16, thereby avoiding damage from freezing, rust, or other moisture-related conditions.

Advantageously, the anchor 14 may be easily placed in soil. The anchor 14 has no external threads, and therefore need not be rotated into place within the soil, but can simply be pressed into the ground 16 by exerting a linear force on the proximal end 30. Removal the anchor 14 from the ground 16 is equally simple.

Figure 8:
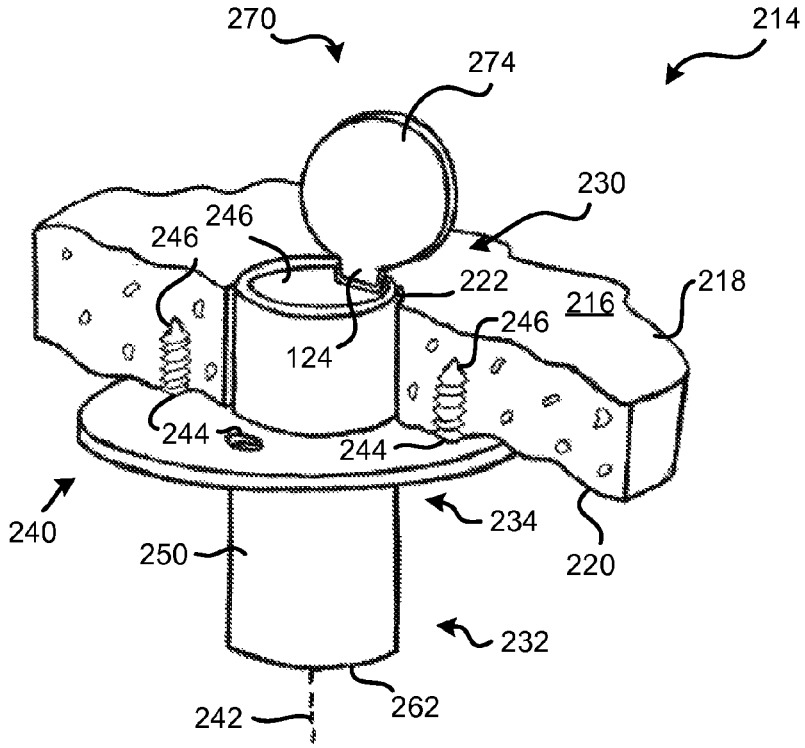
FIG. 8 is a perspective view of an anchor according to one alternative embodiment of the invention, for use with decking or other man-made ground surfaces.

In alternative embodiments, such as that of FIG. 8, the conical end 60 may be omitted in favor of a flat distal end. Such a configuration may be desirable where the anchor (not shown) will not be driven into the ground, but will instead be placed into a pre-drilled or otherwise formed recess. For example, for use in concrete or decking, an anchor may have a flat end, and may be inserted into concrete while wet, or into a drilled opening in concrete or decking.

Figure 3:
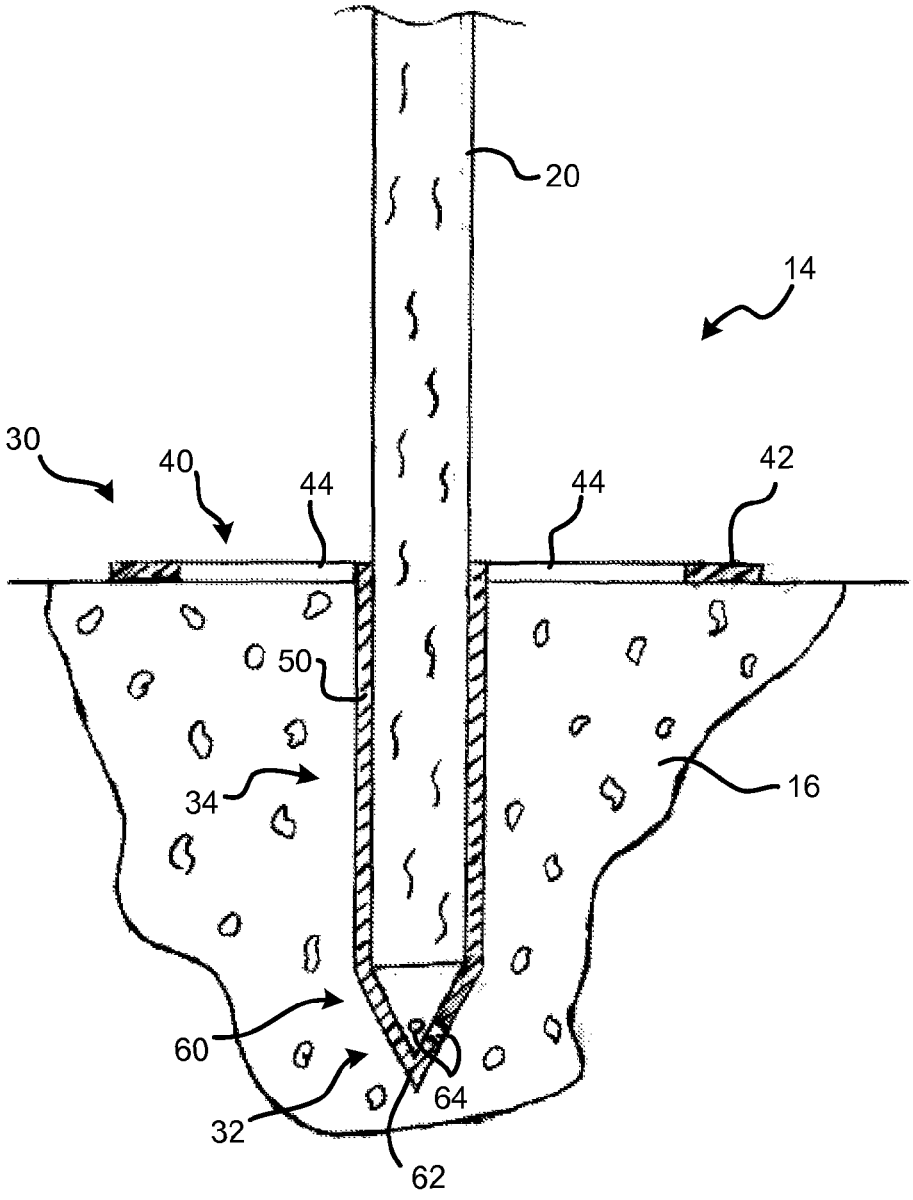
FIG. 3 is a side elevation, section view of the ground, umbrella pole, and anchor of FIG. 1.

Referring to FIG. 3, a side elevation, section view illustrates a portion of the pole 20, the anchor 14, and the ground 16. As shown, the anchor 14 has a low profile, and thus may be left in place in the ground 16 even when the umbrella 12 has been stowed. If desired, the anchor 14 may be painted or otherwise colored to provide a visually unobtrusive façade. Green, brown, or black colors, for example, may be advantageous to enable the anchor 14 to blend in with the ground 14.

In FIG. 3, the anchor 14 is illustrated as being formed of metal, such as a stainless steel. However, in other embodiments, the anchor 14 may be formed of other materials such as aluminum, a polymer, or a composite alloy. Other features such as additional flanges may be added as needed to enhance the strength and/or rigidity of the anchor 14.

Figure 4:
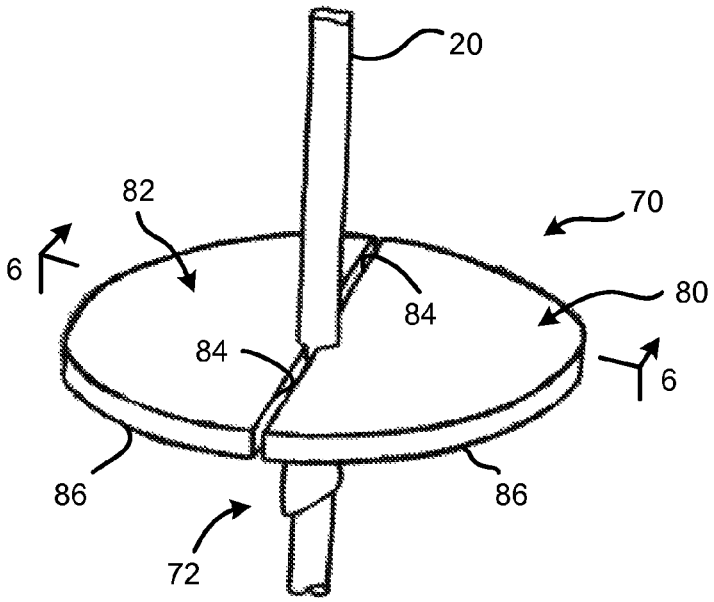
FIG. 4 is a perspective view of a portion of the umbrella pole of FIG. 1, with a portable umbrella table and pole clamp according to one embodiment of the invention.

Referring to FIG. 4, a perspective view illustrates a portion of the pole 20 of the umbrella 12 with a table 70 according to one embodiment of the invention. The table 70 may be supported through the use of a pole clamp 72. The table 70 and pole clamp 72 are designed to be secured to the umbrella 12 after the umbrella 12 has been erected and anchored. This facilitates assembly because the umbrella 12 need not be simultaneously anchored to the ground 16 and coupled to the table 70.

As embodied in FIG. 4, the table 70 has a first half 80 and a second half 82, which are joined together on opposite sides of the pole 20. More precisely, each of the halves 80, 82 has a medial surface 84 and an underside 86. The two medial surfaces 84 are positioned to abut each other and then the two halves 80, 82 are secured together through the use of any of a variety of known mechanisms such as clips, clamps, snaps, and the like. According to one example, the first half 80 has a plurality of pegs (not shown) protruding from its medial surface 84. These pegs fit into corresponding holes (not shown) formed in the medial surface 84 of the second half 82. Latches (not shown) on the undersides 86 are then latched to keep the halves 80, 82 together. The latches may be releasable so as to permit the halves 80, 82 to be withdrawn from each other for transportation.

In FIG. 4, the table 70 rests on the pole clamp 72, which is fixedly secured to the pole 20. In alternative embodiments, the table 70 may rest on a variety of other implements on the pole 20. For example, the table 70 may rest on a ledge formed into the pole 20 as an upwardly-facing surface of a larger-diameter portion of the pole 20. Alternatively, the table 70 may have foldable legs or other features that enable it to be supported by the ground 16.

Figure 5:
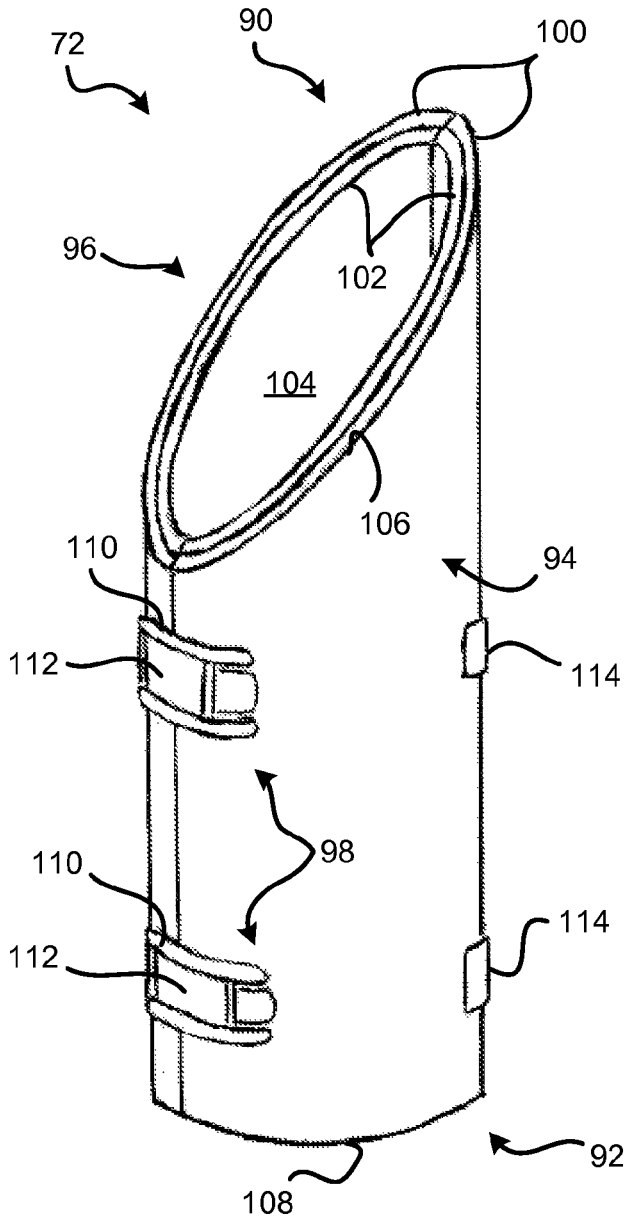
FIG. 5 is a perspective view of the pole clamp of FIG. 4.

Referring to FIG. 5, a perspective view illustrates the pole clamp 72 in greater detail. As shown, the pole clamp 72 has a generally beveled tubular shape with a first end 90 and a second end 92. The pole clamp 72 also has a first half 94 and a second half 96. Each of the halves 94, 96 has a half-tubular shape so that the halves 94, 96 join together to define the beveled tube. The halves 94, 96 may be coupled together via hinges 114 that permit the halves 94, 96 to swing open to receive the pole 20. Clasps 98 on the opposite side of the halves 94, 96 may be used to releasably secure the halves 94, 96 together.

Each half 94, 96 has an outer shell 100 and an inner pad 102. The outer shells 100 may be substantially rigid, while the inner pads 102 may be slightly pliable to enable the pole clamp 20 to securely grip the pole 20 without significantly damaging it. If needed, the inner pads 102 may have roughened surfaces or other features that enhance their traction relative to the surface of the pole 20.

Once closed together, the halves 94, 96 define a bore 104 that may receive the pole 20, for example, such that slight deformation of the inner pads 102 is required to fully close the halves 94, 96 via the clasps 98. The halves 94, 96 then define a first surface 106 on the first end 90, and a second surface 108 on the second end 92. As shown in FIG. 4, the second end 90 may be oriented upwards to enable the table 70 to rest on the second surface 108. The table 70 will then rest perpendicular to the pole 20.

However, in some situations, the umbrella 12 may be anchored at an angle nonperpendicular with the ground 16. For example, the umbrella 12 may be driven into the sand of a beach to provide shade at a desired angle. The first end 90 may then be positioned upward so that the first surface 106 is generally horizontal, enables the table 70 to rest substantially horizontally despite the angle of the pole 20. FIG. 5 illustrates the first surface 106 as residing within a plane angled from a plane containing the second surface 108 by about 45°, thus making the first surface 106 ideal for use when the pole 20 is angled at about 45° from horizontal. In alternative embodiments, the first surface (not shown) may be angled from the second surface at 30°, 15°, or any other angle that matches the desired angulation of the umbrella 12.

The clasps 98 may take a variety of configurations known in the art. According to one example, the clasps 98 may be like those found on briefcases and other closable items in which it is desirable to cinch two parts together and then latch them with one simple motion. Alternatively, the clasps 98 may be configured differently, or replaced with other closure mechanisms known in the art. As shown, each of the clasps 98 has a pair of parallel latch arms 110 and a lever 112 that resides between the parallel latch arms 110 and is actuatable to draw the two halves 94, 96 together and lock them in place.

Figure 6:
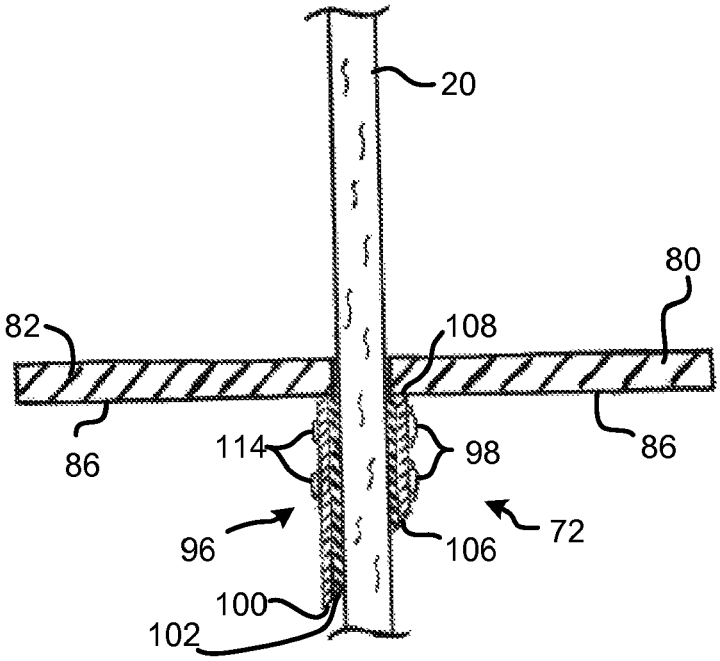
FIG. 6 is a side elevation, section view of a portion of the umbrella pole, table, and pole clamp of FIG. 4.

Referring to FIG. 6, a side elevation section view illustrates the portion of the pole 20, the table 70, and the pole clamp 72 of FIG. 4. As mentioned previously, the table 70 rests on the second surface 108 of the pole clamp 72. The table 70 may be permitted to rotate on the pole clamp 72. Alternatively, the pole clamp 72 may have features (not shown) that engage the table 70 to prevent rotation. For example, pegs (not shown) may protrude from the second surface 108 and fit into corresponding holes in the undersides of the two halves 80, 82 of the table 70. As another alternative embodiment, a pole clamp may be integrated into a table like the table 70, such that, when the two halves of the table are joined, they also tightly engage the pole, thereby obviating the need for a separate pole clamp.

Figure 7:
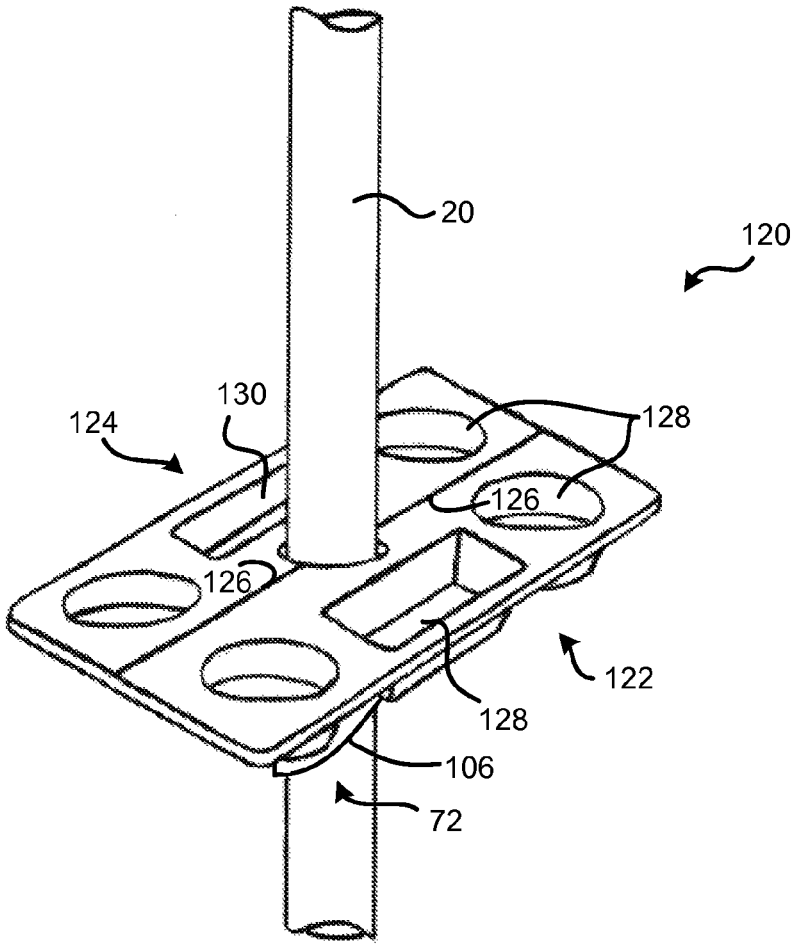
FIG. 7 is a perspective view of a portion of the umbrella pole of FIG. 1, with a portable accessory tray and pole clamp according to one embodiment of the invention.

Referring to FIG. 7, a perspective view illustrates a portable accessory tray 120 supported on the portion of the pole 20 through the use of the pole clamp 72. The accessory tray 120 may be used to hold beverages, silverware, napkins, suntan lotion, or other items. As shown, the accessory tray 120 may have a first half 122 and a second half 124 that are coupled together on either side of the pole 20. Each of the halves 122, 124 has a medial surface 126; the two medial surfaces 126 may be secured together through the use of any known method, or via any of the methods set forth in the description of the medial surfaces 84 of the table 70. The accessory tray 120 may have a variety of features such as cup holders 128 and utensil holders 130. A wide variety of other features may be used in addition to or in place of the cup holders 128 and utensil holders 130.

In FIG. 7, the accessory tray 120 rests on the second surface 108 (not visible in FIG. 7) of the pole clamp 72. In alternative embodiments, the accessory tray 120 may be otherwise supported on the pole 20, on the ground 16, or on a table. In one embodiment, the accessory tray 120 may simply rest on a table like the table 70 or a typical table known in the art. Notably, the anchor 14, table 70, and accessory tray 120 are all usable independently of each other.

Referring to FIG. 8, an anchor 214 is shown according to an alternative embodiment of the invention. The anchor 214 is designed for use with a man-made ground surface such as a deck 216. The deck 216 has a top surface 218 and a bottom surface 220, and may be formed of any of a variety of materials known in the art, including wood, wood laminates, TREX™, concrete, and the like. The deck 216 has a hole 222 that is pre-formed in the material of the deck 216, or drilled or otherwise formed prior to placement of the anchor 214.

The anchor 214 has a proximal portion 230, a distal portion 232, and an intermediate portion 234. A stabilization feature in the form of a flange 240 extends outwardly from an axis 242 of the anchor 214. The flange 240 is not positioned on the proximal portion 230, but rather radiates outwardly from the intermediate portion 234 so as to be positioned to abut the bottom surface 220 of the deck 216. Thus, the flange 240 is not visible to or obtrusive for people standing on the deck 216.

As shown, the flange 240 is secured to the bottom surface 220 of the deck 216. More specifically, the flange 240 has holes 244 through which screws 246 are inserted. In alternative embodiments (not shown), a flange may be secured to the bottom surface 220 through the use of construction adhesives, clamps, clips, nuts, bolts, or any other attachment mechanism known in the art.

The proximal portion 230 has an aperture 246 in communication with a bore extending through the anchor 214. The intermediate portion 234 has a cylindrical outer surface 250, which could alternatively have other shapes including rectangular, square, or other polygonal shapes to accommodate different umbrella poles or add rotational stability to the placement of the anchor 214 within the hole 222.

The distal portion 232 has, in place of a sharp tip for penetrating soil, a flat surface 262, since the hole 222 is formed prior to placement of the anchor 214. The pole 20 is able to slide into the bore of the anchor 214 until the bottom end of the pole 20 contacts the interior of the distal portion 232, which may have a circular surface (not visible) on which the bottom end of the pole 20 rests. Weep holes (not shown) like the weep holes 64 of the anchor 14 may optionally be formed in the distal portion 232.

The anchor 214 also includes a cover 270 that protects the bore from moisture, debris, or other items. The cover 270 also serves to help people avoid stubbing toes on the interior of the aperture 246. The cover 270 has a hinge 272 rotatably coupled to the proximal portion 230 and a plate 274 that rotates to covers the aperture 246 or to expose the aperture 246 for use, as shown in FIG. 8. A wide variety of other covers may be used such as corks, sliding covers, and the like.

Figure 9:
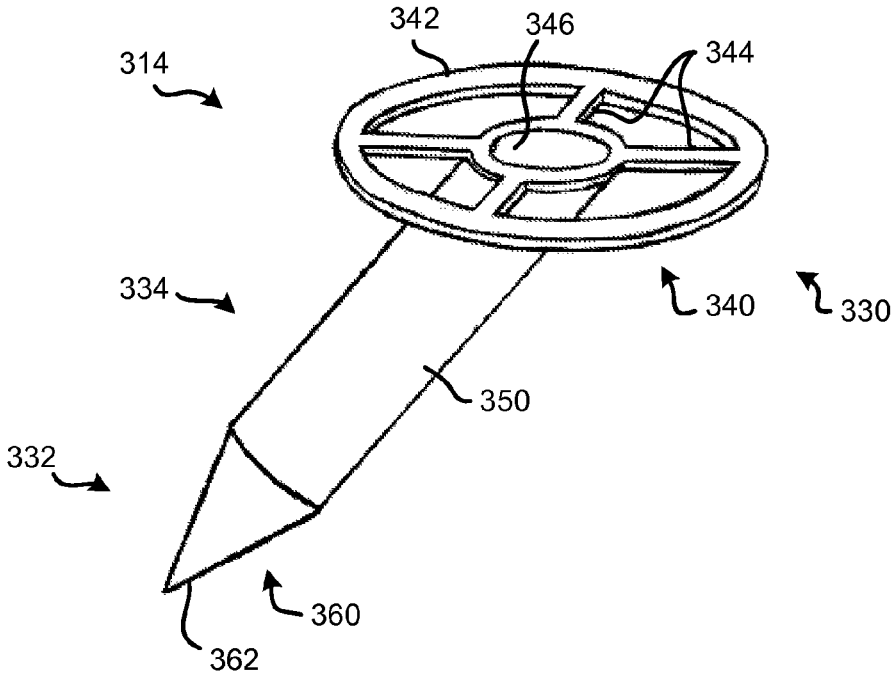
FIG. 9 is a perspective view of an anchor according to another alternative embodiment of the invention, for use in holding an umbrella at angle relative to the ground.

Referring to FIG. 9, an anchor 314 is shown according to another alternative embodiment of the invention. The anchor 314 is similar to the anchor 14 of FIG. 2 except that it is designed to hold the umbrella 12 in an angled orientation. The anchor 14 may be particularly useful for beaches or other locations where a less formal gathering is envisioned.

The anchor 314 has a proximal portion 330, a distal portion 332, and an intermediate portion 334 between the proximal portion 330 and the distal portion 332. The proximal portion 330 has a flange 340 with a ring 342 connected to the central portion of the anchor 314 by spokes 344 that extend radially outward. An aperture 346 is in communication with a bore extending through the anchor 314. The aperture 346 may have an elliptical shape defined by the intersection of a plane with the pole 20 at an angle other than 90°.

The flange 340 may be removable from the remainder of the proximal portion 330. For example, bayonet features, clips, clamps, or other attachment mechanisms may be used to removably secure the flange 340 to the remainder of the proximal portion 330. A removable flange 340 may make it easier to implant the remainder of the anchor 314 in soil. Such a removable stabilization feature could be used with any embodiment of the invention.

Various features of the embodiments set forth above could be combined together to provide other embodiments of umbrella anchors or other accessories according to the present invention. A variety of shapes and/or sizes could be used to provide compatibility with different existing umbrellas or to provide different functionality. Thus, the principles of the present invention may be utilized in many different ways to suit a wide range of applications.

The invention claimed is:

1. A system providing shade above ground, the system comprising:

an umbrella;

an anchor comprising:

a distal portion;

an intermediate portion comprising a smooth-walled bore; and a proximal portion comprising an aperture in communication with the bore, wherein the aperture is shaped to receive a bottom end of a pole of the umbrella to enable insertion of the bottom end into the bore;

wherein the proximal portion comprises a stabilization feature that includes a flange having a plurality of spokes extending outwardly from an axis of the anchor, and a ring connected to distal ends of the spokes to form a proximal surface coplanar with the aperture for engaging the ground to restrict motion of the anchor relative to the ground;

wherein the distal portion is embeddable in the ground in response to exertion of an exclusively linear force urging the proximal portion toward the ground;

wherein the intermediate portion is positioned between the distal portion and the proximal portion such that the intermediate portion does not extend beyond the stabilization feature.

2. The system of claim 1, further comprising the umbrella comprising a canopy sized to provide shade and the pole comprising a bottom end and a top end, wherein the top end is connected to the canopy to support the canopy, the pole having a length selected to maintain the canopy at a desired elevation above the ground when the bottom end is secured to the ground.

3. The system of claim 2, further comprising a table attachable to the pole such that the table substantially encircles the pole and is supported above the ground by the pole when the bottom end of the pole is secured to the ground.

4. The system of claim 3, further comprising a pole clamp rigidly attachable to the pole, the pole clamp comprising a surface on which an underside of the table rests such that the pole clamp supports the table on the pole.

5. The system of claim 4, wherein the pole clamp comprises two portions movably connected together and lockable in a closed configuration around the pole to enable attachment of the pole clamp to the pole after attachment of the bottom end of the pole to the anchor.

6. The system of claim 1, wherein the distal portion comprises a tip shaped for penetrating the ground soil to facilitate pressing of the anchor directly downward into the ground soil.

7. The system of claim 6, wherein the proximal portion comprises the stabilization feature, wherein the stabilization feature comprises the flange oriented generally perpendicular to the intermediate portion to limit a depth of penetration of the tip into the soil.

8. The system of claim 1, wherein the intermediate portion comprises a cylindrical outer surface and the distal portion comprises a generally conical shape, wherein the bore has a generally cylindrical shape.

9. The system of claim 1, wherein the anchor is shaped and configured to be removable from the ground in response to linear force urging the anchor upward.

10. A method for providing shade through the use of an umbrella comprising a canopy sized to provide shade and a pole comprising a bottom end and a top end, wherein the top end is connected to the canopy to support the canopy, the pole having a length selected to maintain the canopy at a desired elevation above the ground when the bottom end is secured to the ground, the method comprising:

embedding at least a portion of an anchor in the wound, the anchor comprising:

a distal portion;

an intermediate portion comprising a bore; and a proximal portion comprising an aperture in communication with the bore;

engaging the ground with a stabilization feature of the anchor to restrict motion of the anchor relative to the ground, wherein the stabilization feature comprises a flange having a plurality of spokes extending outwardly from an axis of the anchor, and a ring connected to distal ends of the spokes to form a proximal surface coplanar with the aperture to engage the ground;

inserting the bottom end of the pole into the aperture; and sliding the bottom end into the bore until the anchor carries the weight of the umbrella;

wherein embedding at least a portion of the anchor in the ground comprises exerting a linear force urging the proximal portion toward the ground in a manner that does not require the exertion of significant torque on the anchor;

wherein embedding at least a portion of the anchor in the ground comprises embedding the distal portion and the intermediate portion in the ground such that bore is positioned substantially below ground level.

11. The method of claim 10, wherein the distal portion comprises a tip, wherein embedding at least a portion of the anchor in the ground comprises pressing the anchor directly downward into a soil of the ground.

12. The method of claim 11, wherein the proximal portion comprises the stabilization feature, wherein the stabilization feature comprises the flange oriented generally perpendicular to the intermediate portion, wherein engaging the ground with the stabilization feature comprises abutting the ground with the flange to limit a depth of penetration of the tip into the soil.

13. The method of claim 10, wherein the intermediate portion comprises a cylindrical outer surface and the distal portion comprises a generally conical shape, wherein the bore has a generally cylindrical shape, wherein the cylindrical outer surface and the generally conical shape are substantially smooth so as to facilitate embedding of the anchor in the ground in response to exertion of the linear force.

14. The method of claim 10, further comprising attaching a table to the pole after sliding of the bottom end of the pole into the bore such that the table substantially encircles the pole and is supported above the ground by the pole.

15. The method of claim 14, further comprising rigidly attaching a pole clamp to the pole such that an underside of the table rests on a surface of the pole clamp.

16. The method of claim 15, wherein the pole clamp comprises two portions movably connected together, the method further comprising moving the two portions to a closed configuration around the pole, wherein rigidly attaching the pole clamp to the pole comprises locking the two portions in the closed configuration around the pole after sliding of the bottom end of the pole into the bore.

17. The system of claim 10, wherein the stabilization feature comprises the proximal surface coplanar with the aperture, wherein sliding the bottom end into the bore comprises moving the bottom end downward below ground-level.

* * * * *